US006941935B2

(12) United States Patent
Collins et al.

(10) Patent No.: US 6,941,935 B2
(45) Date of Patent: Sep. 13, 2005

(54) APPARATUS AND METHOD FOR CONTROLLING THE TEMPERATURE OF A COMPONENT FOR AN INTERNAL COMBUSTION ENGINE

(76) Inventors: Robert Kenneth Collins, P.O. Box 365, Deerfield Beach, FL (US) 33443; Brian Beckenbach, 16968 C.R. 252, McAlpin, FL (US) 32062

( * ) Notice: Subject to any disclaimer, the term of this patent is extended or adjusted under 35 U.S.C. 154(b) by 0 days.

(21) Appl. No.: 10/422,595

(22) Filed: Apr. 24, 2003

(65) Prior Publication Data

US 2004/0079345 A1 Apr. 29, 2004

Related U.S. Application Data

(60) Provisional application No. 60/375,155, filed on Apr. 24, 2002.

(51) Int. Cl.[7] ..... F02M 15/00

(52) U.S. Cl. ..... 123/540; 165/10

(58) Field of Search ..... 123/41.1, 540; 137/375, 340, 334; 165/10; 62/121, 259.2

(56) References Cited

U.S. PATENT DOCUMENTS 5,876,620 A * 3/1999 Tsai ..... 252/70

* cited by examiner

*Primary Examiner*—Andrew M. Dolinar
*Assistant Examiner*—Katrina B. Harris
(74) *Attorney, Agent, or Firm*—Debra J. Fickler

(57) ABSTRACT

An apparatus and method for controlling the temperature of a component of an internal combustion engine is provided. The apparatus may be used to cool the combustibles such as the fuel, gasoline, diesel or alcohol or the inhaled air that is mixed with the fuel before the air and fuel, charge, enters the combustion chamber of the engine. Moreover, the apparatus may be used to cool fluids of an engine or transmission.

6 Claims, 4 Drawing Sheets

APPARATUS AND METHOD FOR CONTROLLING THE TEMPERATURE OF A COMPONENT FOR AN INTERNAL COMBUSTION ENGINE

This application claims the benefit of Provisional Application No. 60/375,155, filed Apr. 24, 2002.

FIELD OF THE INVENTION

The invention relates to a method of cooling the consumables and coolants of an internal combustion engine for the purpose of increasing the horsepower output of the engine. Alternatively, the invention may be used to cool fluid used in the conversion of power created by an internal combustion engine to a transmission for driving the drive wheels of a vehicle. More specifically, a reusable, semi-permanent, temperature control blanket is provided that may be used during the operation of the combustion engine to cool the consumables of the engine and related fluids.

BACKGROUND OF THE INVENTION

Internal combustion engines utilize air and fuel such as gasoline, diesel fuel, alcohol, or alcohol-gasoline. This combination of fuel and air, often referred to as the "charge", enters the combustion chamber and explodes as the piston compresses the charge and along with a spark created by a spark plug, except in traditional diesel engines in which the charge explodes as the diesel and air mixture is compressed. For optimum performance and consistent running of the engine, the combination of air and fuel must be controlled to create a charge that burns efficiently.

Various devices have been developed to control the amount of air and fuel in the charge. Most vehicles including passenger cars and motorcycles, utilize either a traditional carburetion or fuel injection to deliver fuel to the combustion chamber of an engine. Various forms of fuel injection have been developed such as single fuel injector, which sits above a throttle body, that intakes air, combines it with fuel and delivers the mixture to the cylinders. Fuel injectors may also be placed in the intake manifold to inject the fuel as the air travels through the intake and directs the mixture to the engine cylinders. Lastly, direct injection consists of one or more injectors that inject fuel directly into the combustion chamber or cylinder. These fuel injection systems typically utilize a computer, often referred to as the "ECU" (electronic control unit), along with sensors to measure the current operating conditions of the engine such as a manifold absolute pressure sensor, or "MAP" for short, to measure the pressure of air flowing through the intake manifold. The computer may also receive other operational conditions such as engine revolutions per minute, "RPM", or charge temperature. The ECU receives the engine operating conditions and utilizes either algorithms or a look-up table to determine the optimal amount of fuel to inject for the air inspired to increase efficiency of the engine, referred to as stoichiometric ratio (14.7:1 for gasoline engines).

In performance applications such as racing, the driver or crew chief may attempt to control the delivery of fuel and air to the combustion chamber to find the optimum combination for a particular engine and racing application. All engines, including naturally aspirated engines (typically carbureted) and forced air engines (commonly referred to as "blown"), those that super or turbocharged, draw air from the atmosphere. Thus, the racer or crew chief must consider the current environmental conditions the vehicle will be operating in to formulate the most efficient or maximum power producing engine set-up.

Any change in temperature, barometric pressure, humidity or combination thereof will affect the performance characteristics of the engine due to the amount of oxygen available in the air. For example, on a day of low humidity, a standard volume of air will contain a certain percentage of oxygen, water vapor and other gas molecules. As the humidity increases, the amount of water vapor molecules increase and displace the molecules of oxygen and other gases resulting in the same standard volume of air with less oxygen for combustion and water vapor.

To increase the output of an engine (horsepower), many racers and high performance enthusiasts attempt to increase the density of the air the engine draws in. The drawn air is often called a "charge" and increasing the density of the charge means to increase the air molecules, oxygen molecules, in the standard volume of air. Increasing the density of the charge can be achieved by the addition of a turbo charger or a supercharger. The turbo charger uses the exhaust of the engine to turn a compressor that creates the density of the air before it enters the combustion chamber. One disadvantage of the turbo charger is that the exhaust also heats the air drawn into the engine system, which, in turn, partially reduces the density of the charge and thereby reduces the maximum horsepower added by the system. This is often seen in race cars and motorcycles that make more that one run or race in the same day such as in drag racing or in open wheel racing such as Indy car racing. Once the race vehicle has made a qualifying attempt, the crews will attempt to cool the engine by directing air over the engine with a large fan. In drag racing, it very common to see racers place bags of ice on the engine intake manifold or on the air filter canister which is in line with the intake manifold.

Albeit useful, the ice method is not often favored by the racers or the race officials. The melted ice often creates water puddles in the staging areas. Race officials and crews often check these puddles to ensure that the liquid is, in fact, water and not engine oil, transmission fluid or fuel. These liquids are a hazard in the staging areas and require prompt clean up or the wheels of the race vehicles may run through the liquids. Transmission and engine oils on race tires makes the tires slick and may cause them to spin and may cause the race vehicle to go out of control.

Some race engines use a compressor to increase the density of the charge entering the engine by actively drawing in air from the atmosphere and physically compressing it before it enters the combustion chamber. Turbo chargers use the exhaust from the engine to turn the compressor wheel which, in turn, compresses the intake air. The hot exhaust gases not only heat the driving compressor wheel, they also result in some heating the intake air manifold and the air traveling through it. Conversely, superchargers are driving mechanically by typically a drive belt. This assists in increasing the density of the charge because the exhaust does not heat the air entering the system. However, as the engine runs, the combustion process and the supercharger drive mechanism create heat that in turn, heats the components of the engine, including the air intake manifold. Thus, after a run or race, the racer or crew will also attempt to cool the engine and the air intake components by running air over the engine with a fan or by placing a bag of ice on the air intake manifold. As discussed above, this method also creates puddles of water creating the same concerns as stated.

Non-forced air engines, those without turbo or superchargers, also increase the temperature of the air entering the intake manifold by convention of the heat of the engine and friction created by the air molecules entering the intake system. Similarly, a race vehicle left in the sun will also absorb heat from the air and the sunlight. As the warm air heats the vehicle, the air intake manifold begins to warm, and also the gas tank and fuel lines heat up. Many racers and crew will attempt to shield the engine and fuel systems from the sun as the vehicle sits in the sun in the staging areas. Although this helps reduce the sunrays on the vehicle, these systems may still be warmed by the convention of the warm air.

In many forms of racing, strict rules are placed on the engine allowed in the race event. For example, the National Hot Rod Association ("NHRA") limits the modifications on the race vehicles and engines. Thus, if a racer is having problems with the engine temperature and the racer may consider adding a larger volume cooling system. However, the racer must consult the rules to ensure that this modification is allowed. If the modification is not allowed, the racer will often attempt to assists the mandatory cooling system by using fans and ice on the engine in between passes or qualifying runs.

Moreover, many smaller race tracks do not have ice available for purchase at the race track and large tracks typically do not provide vending services during private test track sessions. Thus, the racer or crew must bring ice to the racetrack for use on the race vehicle. Over time, this ice may melt and can no longer be used on the intake manifold or air cleaner. It is not uncommon for the ice to melt by the end of the day.

A portion of the charge entering an engine is fuel. As the race vehicle sits in the sun, its fuel lines and fuel cell or tank also absorbs heat from the atmosphere and sunlight. It is well known in the art of high performance engines that actively cooling the fuel delivered to the engine will increase horsepower output. In drag and street racing the use of nitrous oxide is very common. Besides the fact that nitrous oxide is more combustible than air and fuel alone, the injection of high-pressure nitrous oxide into the air fuel mixture or charger also cools the charge, which increases the horsepower output of the engine. As such, may racers and crews attempt to keep the fuel cool before placing it in the fuel tank or cell. This may be actively done by placing the fuel delivery jug in an air-conditioned portion of the race trailer or tow vehicle or by placing the jug in a tub of water and ice.

Racers often try to cool other components of the race cars such as the fluid in automatic transmissions and the associated torque converters. In drag race applications, some race cars utilize a transmission brake to hold the car at a standing stop while allowing the race to increase the engine revolutions per minute (RPMs). This allows the race to quickly leave the starting line at the beginning of the race. A special solenoid is used to allow the fluid to engage first gear and reverse at the same time. When the solenoid is deactivated, the fluid is re-routed from reverse and car immediate moves in first gear. When the engine RPMs are high at the starting line with the transmission brake activated, the fluid in the transmission is turning the torque converter while the transmission is held. This fast spinning of the torque convert can create large amount of heat. If the racer were to engage the transmission brake and hold the engine at,high RPMs for a few minutes, the fluid temperate can rise over 400° F. and result in burning of the transmission fluid and even the paint on the torque converter. As the transmission fluid becomes hot, it also becomes more viscous or thinner. Thus, if the race car makes back to back runs, the hotter fluid may disengage the transmission brake quicker than when the fluid was cooler. This often results in inconsistent starting times and affects the over-all consistency of the race car. To overcome this inconsistency, racers will add transmission fluid coolers to the automatic transmission system. Likewise, the race may use a fan to blow air across the fluid cooler or transmission to cool the fluid or even place towels previously soaked in ice water around these components. These methods are often impractical in the staging lanes of a drag race and messy.

Therefore, it is desirable to have a cooling system that can be used to cool selective components of an engine or race vehicle after the vehicle has made a run or pass. Moreover, it is desirable to have a temporary cooling system what can be used while the race vehicle is sitting in the staging area of the racetrack without taking power away from the engine such as a 12 Volt fan or one that requires its own power source such as an electrical generator. Furthermore, it is desirable to have a cooling system which can be used as the engine is running that does not take away power from the engine such as fans, air or water pumps. A system for cooling the consumables of the engine that does not create a byproduct is also desired.

BRIEF SUMMARY OF THE INVENTION

The present invention provides a method for cooling the consumables of an internal combustion engine without taking horsepower away from the engine and does not create unwanted byproducts. Moreover, the method provides for cooling or alternative components. The present invention also provides a one-piece cooling device, that does not requiring the addition of coolant or ice packs and being used during the operation of the internal combustion engine.

A single piece temperature control blanket system is provided that contains beads composed of an acrylic polymer. The acrylic polymer is a dry component at room temperatures. The temperature control blanket is composed of fabric such as nylon that allows fluids to pass through the blanket material. When placed in a fluid such as water, the acrylic polymer absorbs water and swells. The acrylic polymer does not dissolve in the fluid and does not under go a phase change such as water to ice. As the acrylic polymer swells it has a gel-like texture and becomes normalizes to a temperature similar to the fluid. In one embodiment, the temperature control blanket was placed in ice water for 30 minutes created a final temperature of the blanket when removed from the ice water of 45 degrees Fahrenheit and maintained its temperature, 45 to 48 degrees for approximately 1 to 5 hours depending upon the atmospheric temperature and application. One embodiment of the temperature control blanket utilizes mechanical fasteners, which may be used to fix the blanket to a component. Once fixed, the temperature control blanket continues to cool the component the engine runs and even while the vehicle is moving.

Alternatively, the temperature control blanket may also be used as a warming blanket. In one embodiment, the temperature control blanket was placed in a microwave for 2 minutes warmed to 130 degrees Fahrenheit and retained its heat for approximately 3 hours. The warming blanket can be used to heat an internal combustion engines during cold startup temperatures and may be placed on the engine to help retain heat previously built up on the engine when in cool air temperatures.

The enclosed blanket temperature control system does not create a byproduct as it warms or cools. Likewise, the acrylic polymer is not accessible and remains within the fabric of the blanket and never undergoes a phase change such as water freezing to ice or ice melting to water. Moreover, the blanket temperature control system may be placed in ice water for a minimum of 30 minutes and will retain its cool temperature over hours. Once the blanket control system warms, it can be placed in a refrigerator to lower its temperature or replaced in a cold fluid. Presently available ice and gel packs require refreezing and replacing as they warm to air temperature. Likewise, chemically reactive cooling packs, which undergo a chemical reaction as a solid component is mixed with the liquid component, are single use cooling packs. The provided blanket temperature control system remains cool or warm for hours without the need for "refreezing" or warming.

DETAILED DESCRIPTION OF THE INVENTION

The invention may be embodied in various forms; however, the invention is described with respect to the illustrated embodiments.

Figure 1:
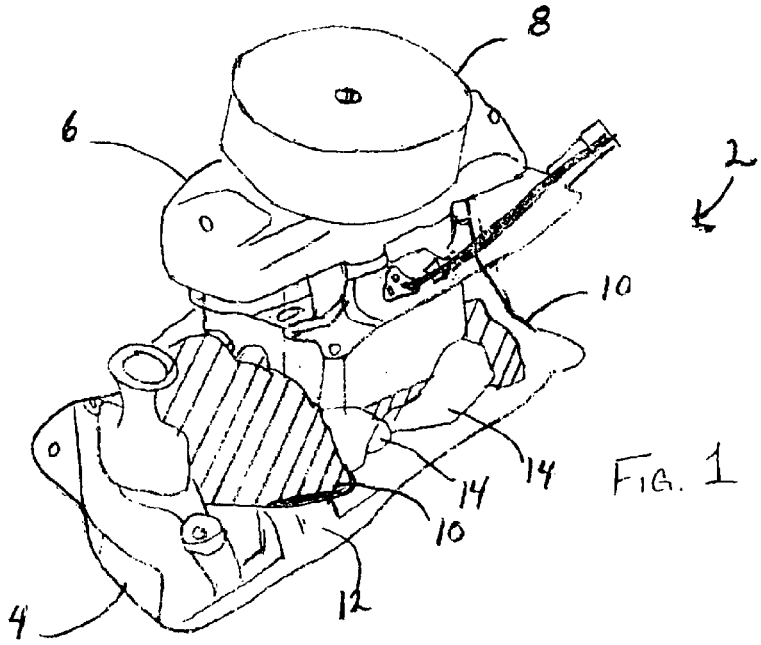
FIG. 1 is a perspective view of a temperature control blanket on an intake manifold of an internal combustion engine having a air filter and carburetor.

An intake system 2 for a natural aspirated engine is shown in FIG. 1. This engine configure includes an intake manifold 4 which sits above the cylinders of the engine, not shown. Intake manifold 4 is typically composed of cast aluminum or alternatively manufactured from sheet aluminum as well known in the arts of engine building. Above and in cooperation with intake manifold 4 is a carburetor 6 and above that, an air filter and casing 8. A temperature control blanket 10 is also shown with the blanket 10 wrapped around an intake runner 12 of intake manifold 4. The temperature control blanket 10 shown in FIG. 1 is temporarily fixed to intake runner 12 by a hook and loop fabric 14.

Figure 2:
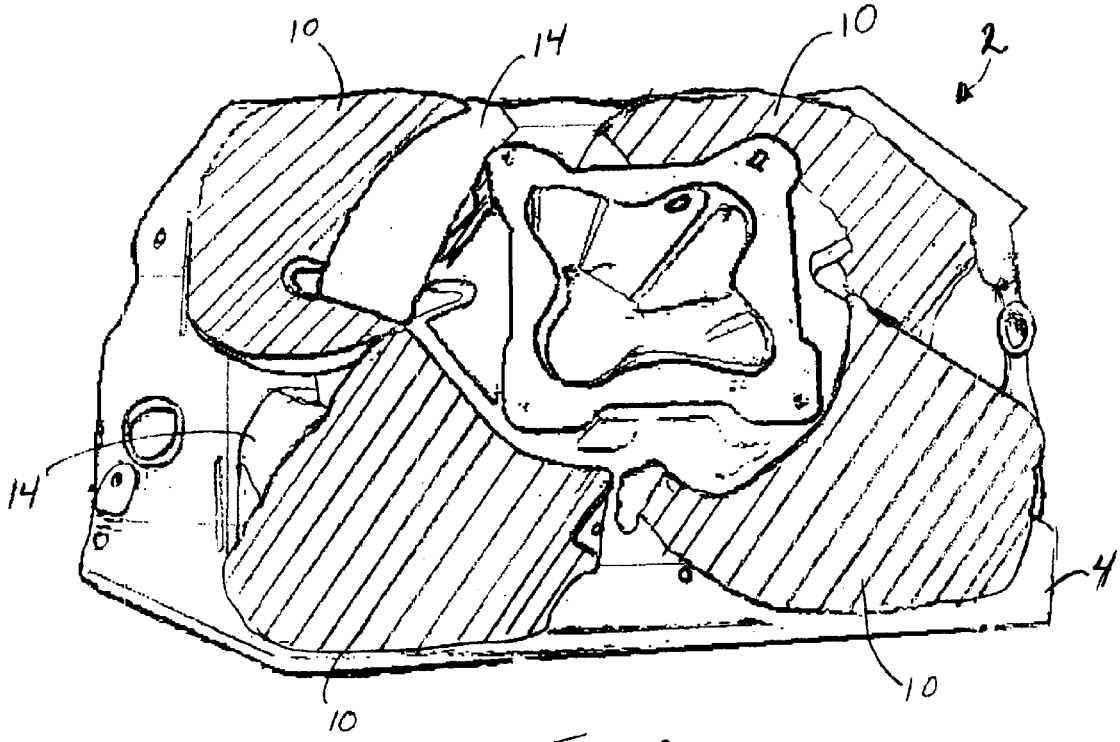
FIG. 2 is a perspective view of the temperature control blanket on an intake manifold without a carburetor or air filter.

Turning to FIG. 2, air cleaner and casing 8 is removed from intake system 2. Four temperature control blankets 10 are temporarily held to intake manifold 4 by wrapping temperature control blanket 10 around intake runner 12. Intake manifold 4 shown has four intake runners 12; each runner 12 feeds the charge (not shown) containing fuel and air to two cylinders (not shown) below intake manifold 4. Each temperature control blanket 10 is equipped with hook and loop fabric 14 to hold temperature control blanket 10 in place. In this configuration, temperature control blanket 10 may be left on intake manifold 4 while the engine is running and while the vehicle (not shown) runs a race, pass or lap. As shown, temperature control blanket 10 is typically used to cool the charge as it travels through runner 12 into the combustion chamber.

Figure 3A:
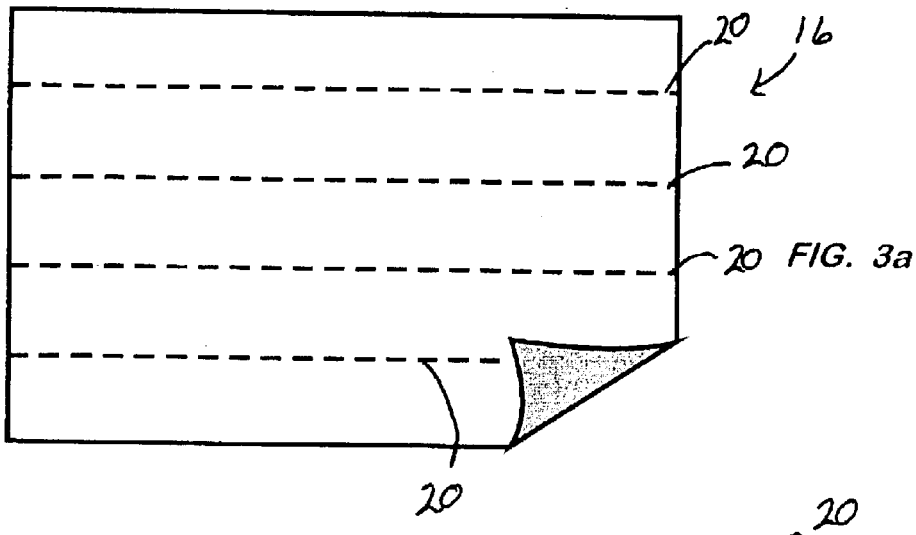
FIGS. 3*a* and 3*b* is a schematic top plan view show of the temperature control blanket having a front side and a second side and a side cut-away view is shown in 3*c;*
Figure 3B:
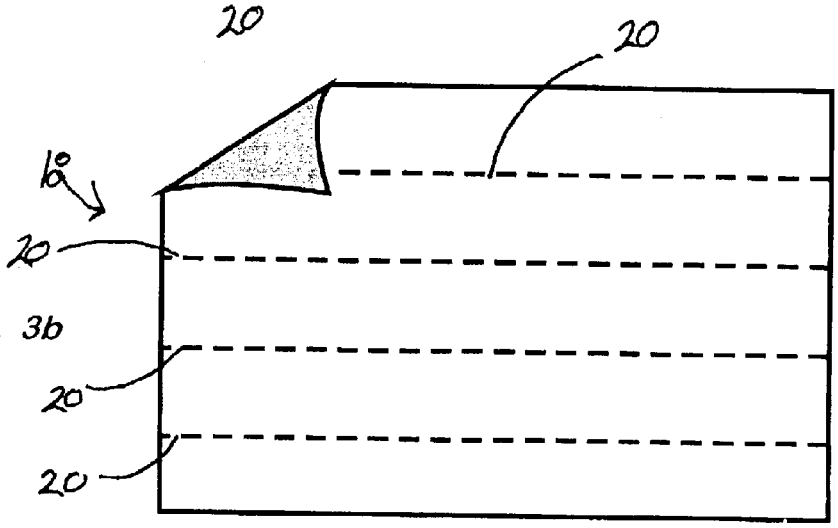
Figure 3C:
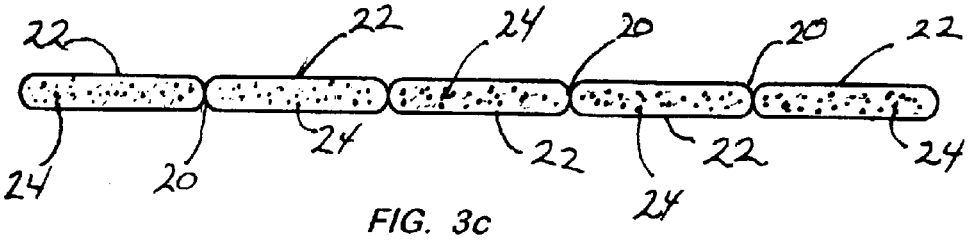

Temperature control blanket 10 is made from a front fabric 16 consisting of a flexible fabric and a back fabric 18 (see FIG. 3). The fabric is woven such that fluid can flow the front fabric 16 and back fabric 18. With the right sides of front fabric 16 and back fabric 18 together, the two pieces are sewn along sew lines 20 shown in FIGS. 3*a* and 3*b*. Once sewn, joined front fabric 16 and back fabric 18 create pockets 22 as illustrated in FIG. 3*c*. Three of the sides of the joined front fabric 16 and back fabric 18 are also sewn such that pockets 22 temporarily have only one end open for access. Acrylic polymer beads 24 are then added to each pocket 22. Approximately ten percent of pocket 22 is filled with acrylic polymer beads 24. Lastly, a binding casing 26 is placed along the perimeter of joined front fabric 16 and back fabric 18 and sewing to encase all sides of temperature control blanket 10 such that the acrylic polymer beads 24 are permanently encased in temperature control blanket 10 (see FIG. 3*c*).

Figure 4A:
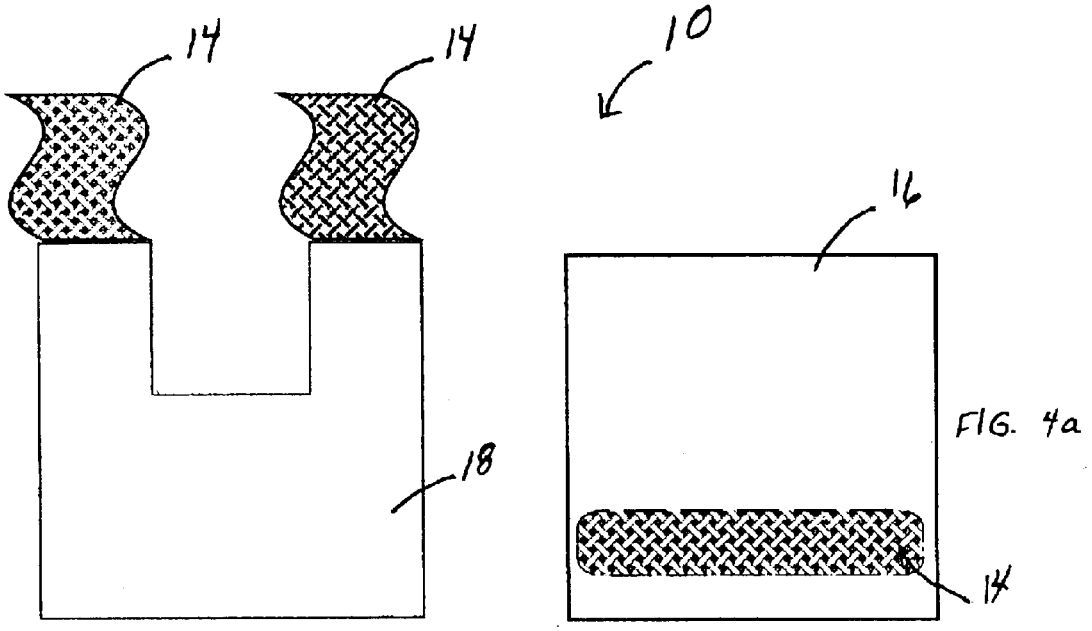
FIG. 4 is a schematic top plan view of the temperature control blanket illustrating two embodiments of a reusable fasteners system.
Figure 4B:
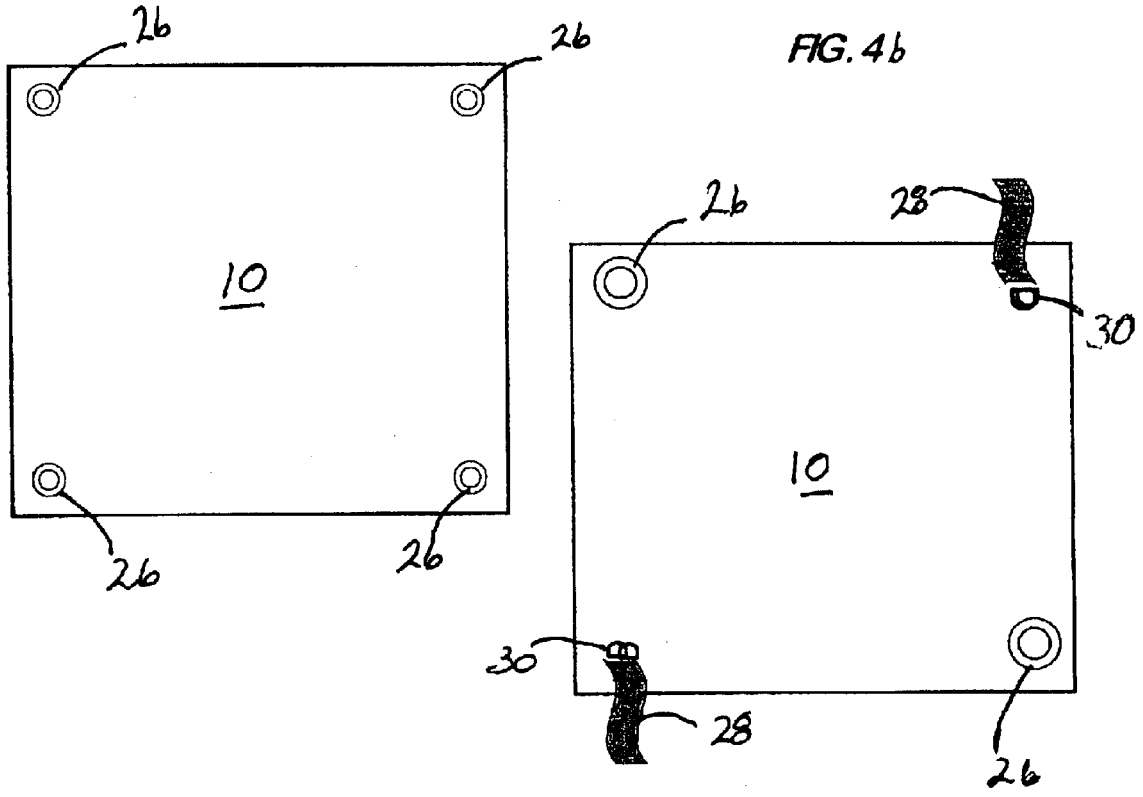

As shown in FIG. 4, various methods may be used to hold temperature control blanket 10 to intake manifold 4 or other structures as discussed below. One such method is to use hook and loop style fabric 14 of adequate grip strength to hold temperature control blanket 10 in place while the engine is running or the vehicle is moving. Two pieces of hook and loop fabric 14 are shown in FIG. 4*a* as used on back fabric 18 of temperature control blanket 10 and the opposite hook and loop fabric 14 is sewn on front fabric 16. Alternatively, plastic or rubber grommets 26 may be placed at the four corners and through temperature control blanket 10 as shown in FIG. 4*b*. Wire ties or zip style ties or hooks can be used to secure temperature control blanket 10 to the desired structure. Also shown in FIG. 4*b* is a third alternative method of securing temperature control blanket 10 utilizing rubber or plastic grommets 26 and high strength nylon straps 28 with a set of "D" style rings 30. This style of fastening system is ideal for use on long cylindrical structure.

Figure 5:
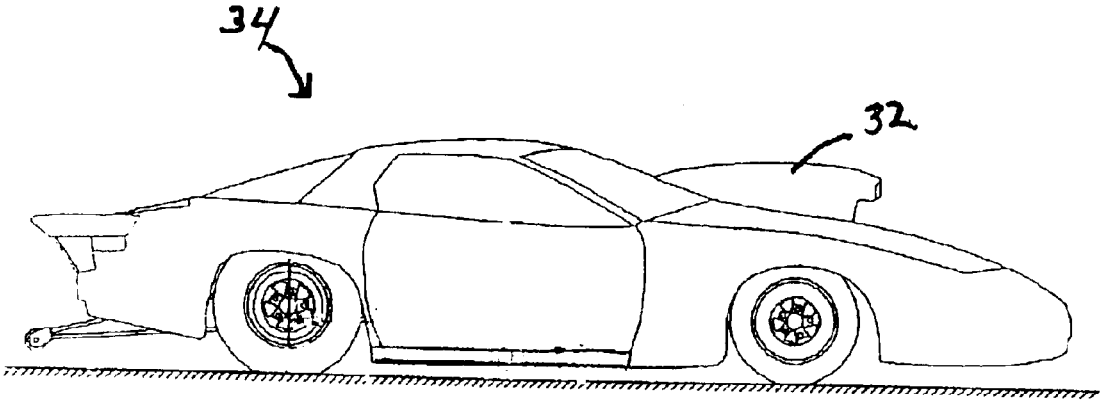
FIG. 5 is a perspective view of the temperature control blanket as used on a hood scoop of a race vehicle.

FIG. 5 illustrates usages of temperature control blanket 10. As shown in FIG. 5, temperature control blanket 10 is placed on a hood scoop 32 of racecar 34. Likewise, temperature control blanket 10 may also be positioned on the fuel cell (not shown) of any race vehicle to cool the fuel, a combustible, before it is mixed with the intake air, or injected into the cylinder for combustion. In sunny racing conditions, temperature control blanket 10 placed in on hood scoop 32 will warm from the radiant heat of the sun. To reduce radiant heating, a reflective shield (not shown) may be placed over temperature control blanket 10.

Figure 6:
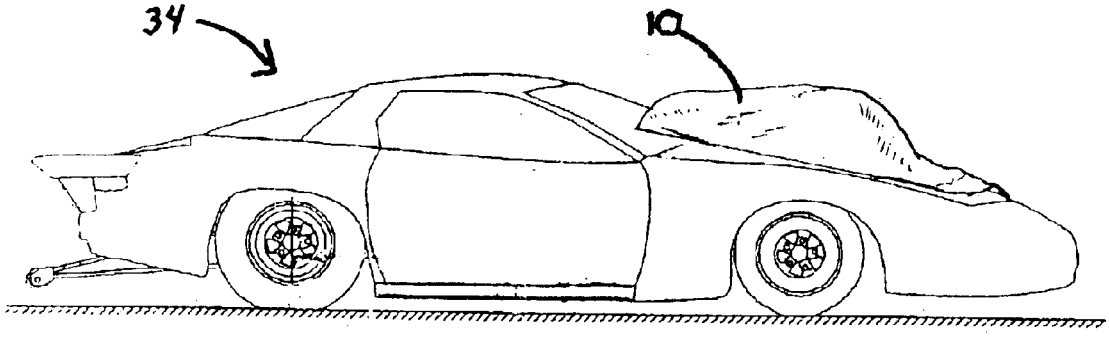
FIG. 6 is a top plan view of the temperature control blanket as used on the air induction pipe of a turbo or supercharger.
Figure 6:
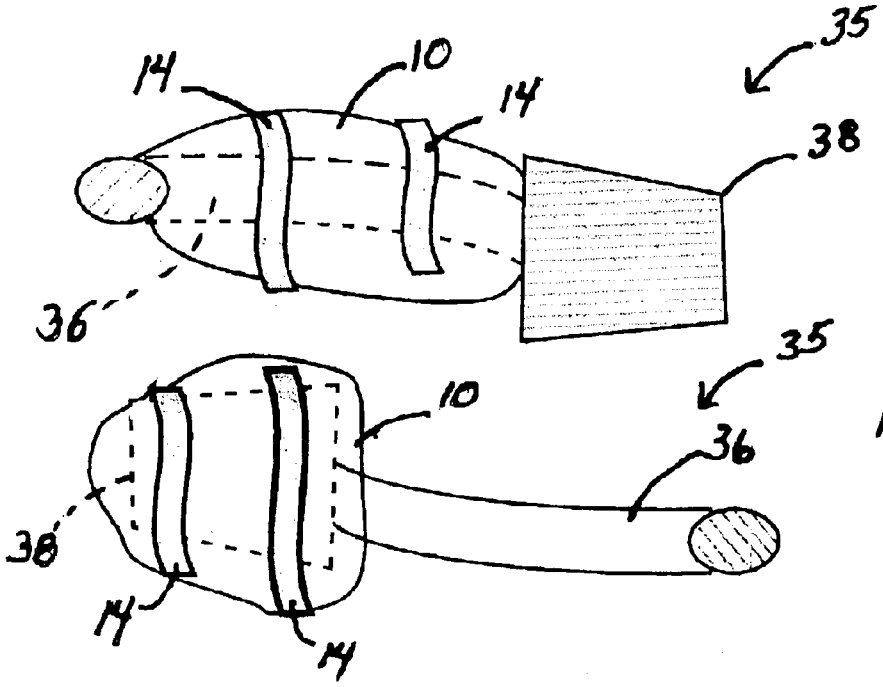

FIG. 6 illustrates an air inductive system 35 for use with an air compressor such as a super or turbo charger (not shown). Temperature control blanket 10 may be wrapped around air inductive tube 36 and secured by hook and loop fabric 14. Likewise, temperature control blanket 10 may also be wrapped around a cone air filter 38 or alternative two temperature control blankets 10 may be placed on both cold air inductive tube 36 and cone air filter 38 to cool the air, a combustible, before it enters the cylinders for combustion.

Alternatively, temperature control blanket 10 may also be used to cool the transmission fluid of an automatic transmission and converter. Temperature control blanket 10 may be placed on a transmission cooler (not shown) or the transmission case itself. Conversely, the temperature controller blanket 10 may also be used to warm the fluid used to maintain the fluid temperature under cold conditions. Moreover, temperature control blanket 10 may be used to speed the cooling process of a component which may need to be touched. For example, temperature control blanket 10 may be placed on the valve cover (not shown) of a cylinder head (not shown) to quickly cool the cover so it may be removed by bare hands.

When warmth is desired, temperature control blanket 10 may be placed in a warm fluid. Once acrylic polymer beads 24 have absorbed fluid and taken on a gel-like state, temperature control blanket 24 may be used to warm components. For example, under cold conditions, engines which burn alcohol may become difficult to start and run inefficiently at cold temperatures. Once the engine has been warmed and shut-down, warm temperature control blanket 10 may be wrapped around an engine to help the engine to retain heat.

Returning to temperature control blanket 10, the acrylic polymer beads 24 have a hard texture before they are submerged in a fluid and are at room temperature. However, if temperature control blanket 10 is placed in a cold fluid such as ice water, acrylic polymer beads 24 begin to absorb the fluid and becomes cool. Likewise, if temperature control blanket 10 is placed in hot water, the beads will absorb the hot water and temperature control blanket 10 becomes hot or warm. Although acrylic polymer beads absorb fluid and take on a gel-like consistence, acrylic polymer beads 10 do not undergo a phase change. Acrylic polymer beads 10 do not freeze when placed in ice water and they do not become a vapor when placed in hot water. Moreover, acrylic polymer beads 24 remain trapped inside front fabric 16 and back fabric 18 and are not removable.

A towel (not shown may be used to remove excess fluid from the fabric 16, 18 of temperature control blanket 10 after it removed from the heating or cooling fluid. Once removed from the fluid, temperature control blanket 10 may be placed on a towel and rolled to absorb any excess fluid. Once acrylic polymer beads 24 have absorbed the fluid, temperature control blanket 10 may be cooled by placing it in a refrigerator or in an ice chest. To prevent the fabric from absorbing fluid, temperature control blanket 10 may be placed in a plastic bag before placed in an ice chest. Conversely, to warm temperature control blanket 10, it may be placed in a warm oven or near a heater.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

We claim:

1. A method of cooling a component, the method comprising:

containing an acrylic polymer in a fluid permeable bag;

soaking the acrylic polymer contained in the fluid permeable bag in a suspension of frozen fluid and fluid; and placing the acrylic polymer on the component.

2. A method of cooling a the combustible mixture of an internal combustion engine having a combustion chamber, the method comprising:

soaking an acrylic polymer in a cool fluid;

placing the acrylic polymer on a component of the combustion engine; and cooling the combustible mixture before the combustible mixture enters the combustion chamber of the internal combustion engine.

3. The method of claim 2 wherein the step of soaking an acrylic polymer in a fluid includes placing the acrylic polymer in a suspension of frozen fluid and fluid.

4. The method of claim 3 wherein the step of soaking an acrylic polymer in a fluid includes containing the acrylic polymer in a fluid permeable fabric.

5. The method of claim 2 wherein the step of placing the acrylic polymer on a component of the combustion engine includes placing the acrylic polymer on an intake runner, intake manifold, fuel cell, fuel tank, fuel line, air cleaner, air filter canister, nitrous oxide container, hood scope, air inductive tube, or valve cover.

6. The method of claim 2 wherein the step of cooling the combustible mixture includes cooling a mixture of atmospheric air and gasoline or alcohol or nitrous oxide or diesel fuel.

* * * * *